US008528784B2

(12) United States Patent
Sim

(10) Patent No.: US 8,528,784 B2
(45) Date of Patent: Sep. 10, 2013

(54) SPRAY BOTTLE WITH REFILL CARTRIDGE

(76) Inventor: Jae K. Sim, Rancho Cucamonga, CA (US)

( * ) Notice: Subject to any disclaimer, the term of this patent is extended or adjusted under 35 U.S.C. 154(b) by 442 days.

(21) Appl. No.: 12/487,125

(22) Filed: Jun. 18, 2009

(65) Prior Publication Data

US 2010/0147887 A1 Jun. 17, 2010

Related U.S. Application Data

(63) Continuation-in-part of application No. 12/270,735, filed on Nov. 13, 2008, now Pat. No. 8,157,131.

(60) Provisional application No. 61/102,734, filed on Oct. 3, 2008.

(51) Int. Cl.
*B67D 7/74* (2010.01)

(52) U.S. Cl.
USPC ..... 222/129; 222/383.1; 222/325

(58) Field of Classification Search
USPC ..... 222/129, 325, 321.1, 321.7, 321.8, 222/383.1, 382, 464.1, 136, 135; 206/219
See application file for complete search history.

(56) References Cited

U.S. PATENT DOCUMENTS

| | | | |
|---|---|---|---|
| 2,642,065 | A | 4/1951 | Negri |
| 3,024,947 | A | 3/1962 | Jeynes, Jr. et al. |
| 3,080,094 | A | 3/1963 | Modderno |
| 3,134,505 | A | 5/1964 | Modderno |
| 3,172,568 | A | 3/1965 | Modderno |
| 3,221,946 | A | 12/1965 | Riley |
| 3,240,391 | A | 3/1966 | Garton |
| 3,240,403 | A | 3/1966 | Modderno |
| 3,255,924 | A | 6/1966 | Modderno |
| 3,255,926 | A | 6/1966 | Modderno |
| 3,314,563 | A | 4/1967 | Mounier |
| 3,318,484 | A | 5/1967 | Modderno |

(Continued)

FOREIGN PATENT DOCUMENTS

| | | |
|---|---|---|
| DE | 8101400 | 5/1981 |
| DE | 3535986 | 4/1987 |

(Continued)

*Primary Examiner* — Paul R Durand
*Assistant Examiner* — Donnell Long
(74) *Attorney, Agent, or Firm* — Stetina Brunda Garred & Brucker

(57) ABSTRACT

Refill assemblies are described herein that include: a bottle defining an internal reservoir and an opening which communicates with the reservoir; and a refill cartridge operatively coupled with the bottle, the refill cartridge including: a cartridge body defining a cartridge reservoir having a concentrated chemical agent stored therein, a refill pouch having a concentrated chemical agent stored therein or a combination thereof; and a release mechanism cooperatively engaged to the cartridge body that facilitates the flow of the chemical agent from the cartridge reservoir into the reservoir of the bottle. Refill assemblies are also disclosed that include: a spray bottle and/or containment vessel; a refill cartridge cooperatively engaged to the spray bottle and/or containment vessel and including a cartridge body defining a cartridge reservoir having a concentrated chemical agent stored therein; and a release mechanism cooperatively engaged to the cartridge body and selectively movable from a sealing position to a dispensing position relative thereto, the movement of the release mechanism from the sealing position to the dispensing position facilitating the flow of the chemical agent from the cartridge reservoir. Some refill assemblies also include: a bottle having an internal reservoir; and a refill cartridge operatively coupled to the bottle and at least partially residing within the reservoir thereof.

20 Claims, 9 Drawing Sheets

(56) References Cited

U.S. PATENT DOCUMENTS

| | | | |
|---|---|---|---|
| 3,458,076 | A | 7/1969 | Babcock |
| 3,548,562 | A | 12/1970 | Schwattzman |
| 3,613,955 | A | 10/1971 | Wetherell, Jr. |
| 3,648,899 | A | 3/1972 | Lukesch et al. |
| 3,655,096 | A | 4/1972 | Easter |
| 3,891,125 | A | 6/1975 | Morane et al. |
| 4,221,291 | A | 9/1980 | Hunt |
| 4,613,061 | A | 9/1986 | Meuresch et al. |
| 4,705,191 | A | 11/1987 | Itzel et al. |
| 4,757,916 | A | 7/1988 | Goncalves |
| 4,950,237 | A | 8/1990 | Henault et al. |
| 5,246,142 | A | 9/1993 | DiPalma |
| 5,273,189 | A | 12/1993 | Jouillat |
| 5,348,060 | A | 9/1994 | Futagawa et al. |
| 5,421,483 | A | 6/1995 | Parise |
| 5,875,888 | A | 3/1999 | Albisetti |
| 5,927,549 | A | 7/1999 | Wood |
| 5,944,223 | A | 8/1999 | Klima et al. |
| 5,957,335 | A | 9/1999 | Otto |
| 5,992,693 | A | 11/1999 | Albisetti |
| 6,041,969 | A | 3/2000 | Parise |
| 6,053,371 | A | 4/2000 | Durliat |
| 6,152,326 | A | 11/2000 | Klima, Jr. et al. |
| 6,155,459 | A | 12/2000 | Bunschoten |
| 6,182,865 | B1 | 2/2001 | Bunschoten |
| 6,290,100 | B1 | 9/2001 | Yacko et al. |
| 6,360,918 | B1 | 3/2002 | Butler |
| 6,997,351 | B2 * | 2/2006 | Cho ..... 222/82 |
| 7,066,354 | B2 | 6/2006 | Stank |
| 7,331,486 | B2 | 2/2008 | Mon |
| 2007/0228074 | A1 * | 10/2007 | Mueller et al. ..... 222/129 |
| 2009/0139882 | A1 | 6/2009 | DeJonge |

FOREIGN PATENT DOCUMENTS

| | | |
|---|---|---|
| EP | 101594 | 2/1984 |
| EP | 173547 | 3/1986 |
| EP | 333541 | 9/1989 |
| EP | 341115 | 11/1989 |
| FR | 2239390 | 2/1975 |
| GB | 2220930 | 1/1990 |
| IT | 1188018 | 12/1987 |

* cited by examiner

SPRAY BOTTLE WITH REFILL CARTRIDGE

This application is a divisional of pending application Ser. No. 12/486,982, filed Jun. 18, 2009, which is a continuation in part of pending application Ser. No. 12/270,735, filed Nov. 13, 2008 and which claims priority to provisional application Ser. No. 61/105,734, filed Oct. 3, 2008, all of which are incorporated herein by reference in their entirety.

FIELD OF THE SUBJECT MATTER

Spray bottles and refill cartridges for corresponding spray bottles are disclosed herein, including an easy to use refill cartridge configured to be disposed within the spray bottle during use.

BACKGROUND

It is well known to utilize spray bottles to dispense a fluid. For instance, cleaners, cosmetics, and other fluids are commonly sold in spray bottles to facilitate dispensing by a user. After repeated use of the spray bottle, the amount of liquid in the bottle decreases to the point where the spray bottle is effectively empty.

Once the spray bottle is empty, many users are inclined to throw the empty spray bottle away and purchase a new one, despite the fact that the empty spray bottle is still functional. Given that a typical spray bottle is generally designed to hold a small amount of fluid (i.e., one quart), a user may quickly consume all of the fluid contained within the spray bottle. As such, a large number of spray bottles may be used over a short period of time.

Most spray bottles are formed out of environmentally harmful materials, such as plastics, which tend to break down into smaller and, in some instances, more harmful components. If the bottles are designed to break down into environmentally acceptable components, then the question is whether they can degrade in the depths of a landfill.

In addition, many communities do not recycle plastics or are limited as to the plastics that are recycled. In some communities, if the bottles aren't clean when recycled, waste management may decide to add them to the landfill despite the consumer's good intentions. The production of plastics also contribute to environmental hazards, such as water and air contamination, harm to fish and wildlife, along with potentially adulterating the food supply. Therefore, large consumption of plastic bottles, such as spray bottles may have detrimental effects on the environment.

One alternative is to purchase a large refill that is capable of filling up the original bottle several times with the fluid. While these refills allow the user to reuse the original bottle multiple times, the problem of reducing waste isn't realized, as the larger refill bottle contains more plastic material and needs to be thrown away when empty.

Another alternative is to purchase a refill which usually contains a smaller amount of the fluid in a higher concentration. The fluid in the refill can be poured into the original spray bottle and mixed with water or other diluting fluids to fill the spray bottle. Purchasing a refill tends to be more environmentally friendly, as the refill container is typically smaller than the original spray bottle container. Furthermore, the refill tends to be less expensive than purchasing a new spray bottle.

Although purchasing a refill offers certain advantages, such as smaller containers and less plastic waste, many consumers are more likely to purchase a brand new spray bottle rather than purchase a refill. Some consumers also throw away a spray bottle when it is empty rather than storing an empty spray bottle until they can buy a refill. Once the consumer throws the empty spray bottle away, there are precluded from purchasing a refill. Furthermore, when refills are sold on a shelf next to a full spray bottle, consumers may be inclined to purchase the new spray bottle rather than the refill.

Therefore, there is a need for new spray bottles and corresponding refills that can be utilized with original spray bottles, are coupled with the original spray bottle, are capable of dissolving—at least in part—in some instances to reduce waste, are contained in such a way as to remain clean and neat during transition from the original solution to the refill solution, and are generally easy to use, which may be the most important key to enticing a consumer to try and continue using the product.

SUMMARY OF THE SUBJECT MATTER

Refill assemblies are described herein that include: a bottle defining an internal reservoir and an opening which communicates with the reservoir; and a refill cartridge operatively coupled with the bottle, the refill cartridge including: a cartridge body defining a cartridge reservoir having a concentrated chemical agent stored therein, a refill pouch having a concentrated chemical agent stored therein or a combination thereof; and a release mechanism cooperatively engaged to the cartridge body that facilitates the flow of the chemical agent from the cartridge reservoir into the reservoir of the bottle.

Refill assemblies are also disclosed that include: a spray bottle; a refill cartridge cooperatively engaged to the spray bottle and including a cartridge body defining a cartridge reservoir having a concentrated chemical agent stored therein; and a release mechanism cooperatively engaged to the cartridge body and selectively movable from a sealing position to a dispensing position relative thereto, the movement of the release mechanism from the sealing position to the dispensing position facilitating the flow of the chemical agent from the cartridge reservoir.

Refill assemblies are also disclosed that include: a containment vessel; a refill cartridge cooperatively engaged to the containment vessel and including a cartridge body defining a cartridge reservoir having a concentrated chemical agent stored therein; and a release mechanism cooperatively engaged to the cartridge body and selectively movable from a sealing position to a dispensing position relative thereto, the movement of the release mechanism from the sealing position to the dispensing position facilitating the flow of the chemical agent from the cartridge reservoir. Suitable containment vessels a spray bottle, a squirt bottle, an aerosol can or bottle or another suitable container.

Some refill assemblies also include: a bottle having an internal reservoir; and a refill cartridge operatively coupled to the bottle and at least partially residing within the reservoir thereof.

DETAILED DESCRIPTION

Figure 1:
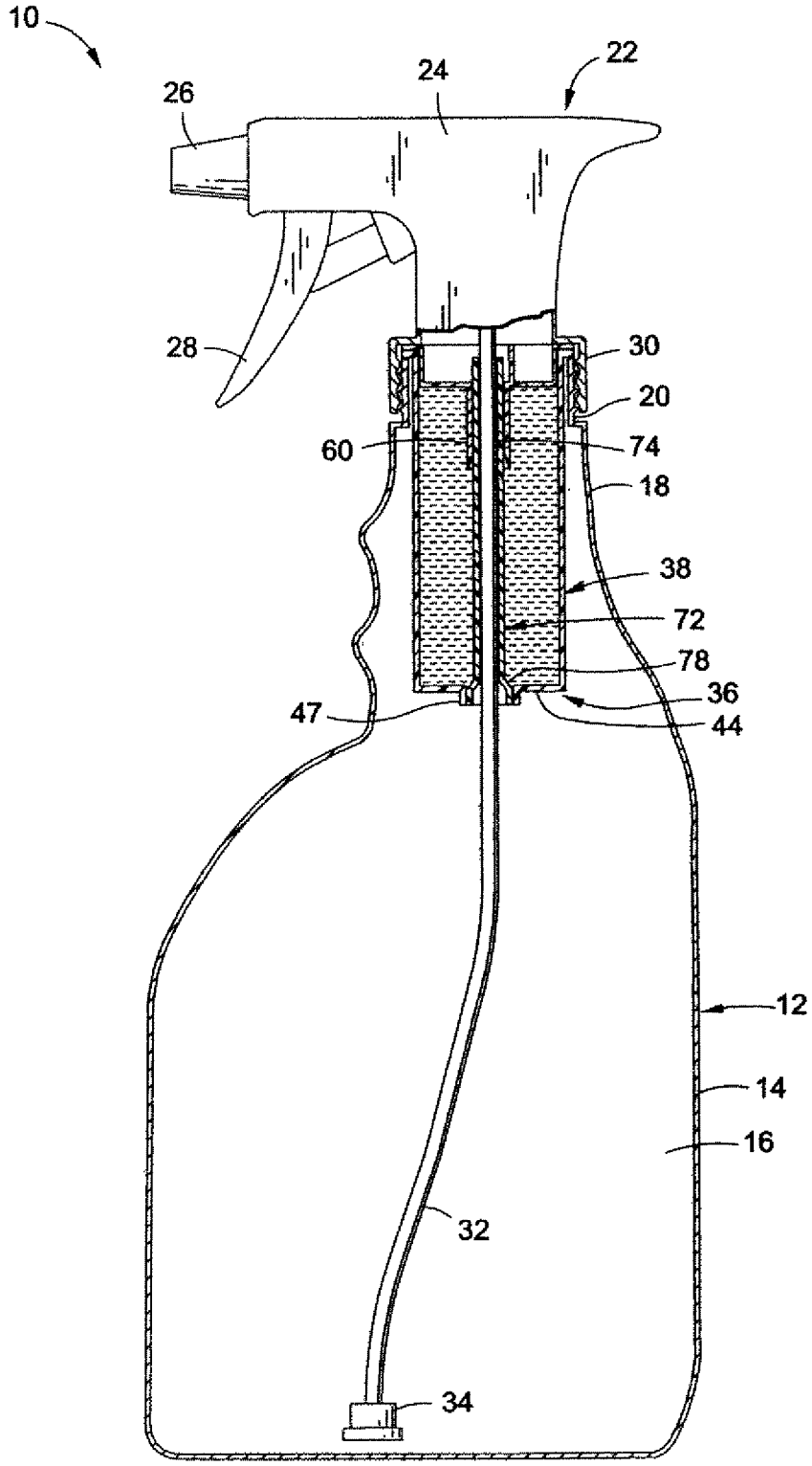
FIG. 1 is a side sectional view of a spray bottle assembly constructed in accordance with a contemplated embodiment, the spray bottle assembly including a bottle, a pumping mechanism, and a refill cartridge having a cartridge body, a cap, and a release mechanism, which in this embodiment is a plug.
Figure 2:
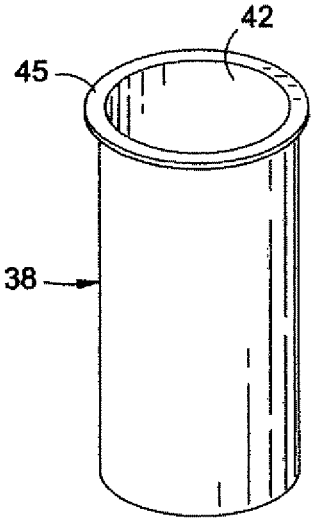
FIG. 2 is a top perspective view of the cartridge body of the refill cartridge.
Figure 3:
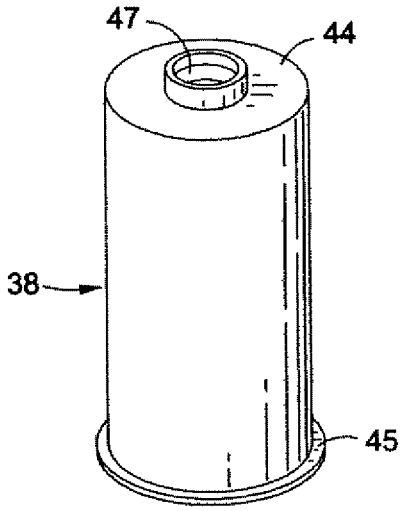
FIG. 3 is a top perspective view of the cartridge body illustrated in FIG. 2, the cartridge body being rotated 180 degrees.
Figure 4:
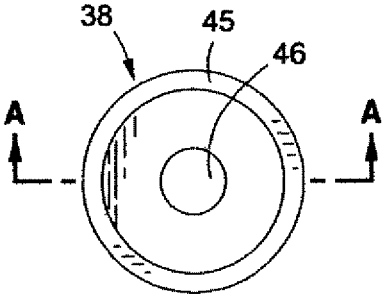
FIG. 4 is a top plan view of the cartridge body.

New spray bottles, containment vessels and corresponding refills have been designed and are disclosed herein that can be utilized with original spray bottles, are coupled with the original spray bottle, may be capable of dissolving—at least in part—in some instances to reduce waste, are contained in such a way as to remain clean and neat during transition from the original solution to the refill solution, and are generally easy to use, which may be the most important key to enticing a consumer to try and continue using the product.

Contemplated spray bottles, containment vessels and refills comprise a coordinated set of products that can be utilized to minimize waste, costs and provide consumers with options as to when and how to refill liquid products. One significant advantage to contemplated embodiments is that a consumer's storage options do not need to be large or segregated away from other cleaners and household products. Contemplated refill assemblies comprise chemical agents, wherein the chemical agent comprises a liquid, a gel, a solid tablet, a plurality of solid granules or a combination thereof.

FIGS. 1-13 illustrate a spray bottle assembly 10 constructed in accordance with a contemplated embodiment. The spray bottle assembly 10 may be used to easily dispense fluids, such as cleaning fluids, detergents, cosmetic fluids, perfumes, or other suitable fluids. As described in more detail below, the spray bottle assembly 10 includes a pumping mechanism 22, a bottle 12 and a refill cartridge 36 that is disposable within the bottle 12. It is contemplated that the refill cartridge 36 may be packaged within the bottle 12 for sale. The easy-to-use configuration of the refill cartridge 36 allows for simple refilling of the bottle 12, thereby extending the usage of the bottle 12, which provides environmental and economic advantages.

Some contemplated refill assemblies are described herein that include: a bottle defining an internal reservoir and an opening which communicates with the reservoir; and a refill cartridge operatively coupled with the bottle, the refill cartridge including: a cartridge body defining a cartridge reservoir having a concentrated chemical agent stored therein, a refill pouch having a concentrated chemical agent stored therein or a combination thereof; and a release mechanism cooperatively engaged to the cartridge body that facilitates the flow of the chemical agent from the cartridge reservoir into the reservoir of the bottle.

Some contemplated refill assemblies are also disclosed that include: a spray bottle; a refill cartridge cooperatively engaged to the spray bottle and including a cartridge body defining a cartridge reservoir having a concentrated chemical agent stored therein; and a release mechanism, which may comprise a plug, a removable strip, a removable disk or another suitable release mechanism, cooperatively engaged to the cartridge body and selectively movable from a sealing position to a dispensing position relative thereto, the movement of the release mechanism from the sealing position to the dispensing position facilitating the flow of the chemical agent from the cartridge reservoir. It should be understood that the selectively movable release mechanism may be completely physically punched out of the cartridge body, may be selectively moved from a closed position vertically to an open position without being completely physically removed from the cartridge body, may be selectively moved from a closed position laterally, slideably and/or horizontally to an open position without being completely physically removed from the cartridge body.

Additional contemplated refill assemblies are also disclosed that include: a containment vessel; a refill cartridge cooperatively engaged to the containment vessel and including a cartridge body defining a cartridge reservoir having a concentrated chemical agent stored therein; and a release mechanism cooperatively engaged to the cartridge body and selectively movable from a sealing position to a dispensing position relative thereto, the movement of the release mechanism from the sealing position to the dispensing position facilitating the flow of the chemical agent from the cartridge reservoir. Suitable containment vessels a spray bottle, a squirt bottle, an aerosol can or bottle or another suitable container. In these embodiments, as with earlier embodiments that comprise a release mechanism, such as a plug, it should be understood that the selectively movable release mechanism may be completely physically punched out of the cartridge body, may be selectively moved from a closed position vertically to an open position without being completely physically removed from the cartridge body, may be selectively moved from a closed position laterally, slideably and/or horizontally to an open position without being completely physically removed from the cartridge body.

Some refill assemblies also include: a bottle having an internal reservoir; and a refill cartridge operatively coupled to the bottle and at least partially residing within the reservoir thereof.

In some embodiments, once the refill cartridge is empty, additional refill cartridges may be inserted into the bottle or into the empty original refill cartridge in order to dispense additional concentrated liquid. In these embodiments, a liquid pouch or degradable cartridge is placed inside the original refill cartridge or into the bottle. When water or another liquid/solvent is placed in contact with the liquid pouch or degradable cartridge, the liquid pouch or degradable cartridge melts or otherwise degrades to release the concentrated ingredients. At this point, there is no additional material or cartridge for the consumer to discard, since it becomes part of the diluted solution, and the original refill cartridge remains useful in the spray bottle. In related embodiments, the bottom of the refill cartridge comprises a perforated or "net-like" material that allows for liquid to migrate from the inside of the bottle to the inside of the refill cartridge and back into the inside of the bottle without any special action by the consumer. This membrane will allow degradable refill pouches to be used in the already existing refill cartridge without disposal of the original spray bottle.

In some embodiments, a contemplated refill cartridge may be initially located inside the spray bottle or containment vessel, such that when the user is ready to refill the bottle or vessel, the cartridge is removed, suitably opened and the contents of the cartridge dispensed into the bottle or vessel. The refill cartridge may then be recycled or otherwise disposed of by the user.

In some embodiments, a contemplated refill cartridge may be coupled to the spray bottle, such that it is physically located outside of the spray bottle but may be opened such that the liquid inside of the refill is dispensed into the inside of the bottle. For example, the refill may screwed on to the outside and comprise a pull tab opening on the side. When the refill is screwed into place on the outside of the bottle, such as on the sides, top or bottom of the bottle, the pull tab release mechanism can be removed and the refill liquid dispenses into an opening on the bottle. The opening on the bottle is not exposed to the outside environment, as the refill cartridge is covering it.

In another embodiment, the refill cartridge may be located on the bottom of the spray bottle, such that the cartridge couples to or slides on to the bottom of the bottle in order to form the physical bottom of the spray bottle. In other embodiments, the cartridge slides into a bottom or side pocket on the spray bottle such that it locks into place and can be dispensed into the inside of the spray bottle without leakage. In these embodiments, the refill cartridge can be designed with a release mechanism, such as a plug or coupling unit, that couples the cartridge to the bottle, it can be designed with a pull tab that can be removed once it is locked into place or can be designed with a degradable section that melts or degrades when exposed to the diluting liquid.

In all of these embodiments, the original spray bottle assembly may comprise a contemplated liquid that was originally loaded into the bottle and one refill cartridge that is designed to refill the bottle with the addition of a diluting liquid. The consumer can then choose to purchase additional refill cartridges or refill pouches or may decide to purchase a new spray bottle assembly.

Referring again to FIG. 1, the spray bottle assembly 10 includes the pumping mechanism 22 that is engageable with the bottle 12. The pumping mechanism 22 includes a body 24 having a nozzle 26, a trigger 28, and a tube 32 connected thereto. The tube 32 defines a tube end 34 that is disposable within a fluid for purposes of dispensing the fluid through the nozzle 26. In this manner, the nozzle 26 is in fluid communication with the tube 32.

The trigger 28 is moveable relative to the body 24 to dispense fluid from the nozzle 26. More specifically, the trigger 28 is moveable between an extended position and a retracted position relative to the body 24. As the trigger 28 moves from the extended position toward the retracted position, fluid is communicated from the tube 32 to the nozzle 26. In one embodiment, the trigger 28 is biased towards the extended position. The biasing force may be provided by a spring or other biasing elements.

In one contemplated embodiment, the pumping mechanism includes a spray dispenser, instead of a trigger, such that the spray dispenser moves up and down when pressure is applied to the top by a finger or thumb. This type of spray dispenser is commonly found on Lysol® containers, hairspray containers, Pledge® containers and other similar containers. These are containers that merely dispense the liquid in nebulized form from the container without the addition of pressure in the can or container.

The nozzle 26 may be moveable relative to the body 24 to control the output of fluid therethrough. In particular, the nozzle 26 may be configured to dispense a fluid in a stream-like manner, or in a mist. In this regard, the nozzle 26 may rotate relative to the body 24 to modify the fluid output from a stream to a mist. The nozzle 26 may also be closed to restrict the passage of fluid therethrough.

According to one embodiment, the pumping mechanism 22 is attachable to the bottle 12 via a pump attachment element 30 that is sized and configured to engage with an engagement region 20 formed on the bottle 12 and defining a rim thereof. In some embodiments, the engagement region 20 comprises threads formed on the exterior of the neck portion 18 of the bottle 12. The tube 32 may extend into the interior of the bottle 12 (which is typically fluid-filled) when the pumping mechanism 22 is connected to the bottle 12. In the embodiment illustrated in FIG. 1, the attachment element 30 includes internal threads that engage with external threads of the engagement region 20 disposed on the neck portion 18 of the bottle 12. The internal threads engage with the external threads as the attachment element 30 is rotated or screwed onto the bottle 12. Although the embodiment illustrated in the drawings shows an attachment element 30 having internal threads, it is understood that other embodiments may include external threads that engage with internal threads formed in the bottle 12. Furthermore, it is contemplated that other embodiments of the attachment element 30 will not threadably engage with the bottle 12. For instance, various mechanical fasteners known in the art may be used to engage the pumping mechanism 22 to the bottle 12.

The bottle 12 includes a bottle wall 14 that comprises a substantially fluid impermeable material, such as plastic, rubber, or other materials known in the art. The size and shape of the bottle 12 may vary. The bottle 12 depicted in FIG. 1 includes an ergonomic gripping portion configured to assist a user in grasping the bottle 12. The bottle wall 14 defines a reservoir 16 configured to receive a fluid, such as a cleaning fluid, or other fluids.

In operation, the pumping mechanism 22 is connected to a fluid filled bottle 12, with the tube 32 extending into the interior of the bottle 12. As a user repeatedly moves the trigger 28 from the extended position to the retracted position, the fluid contained within the bottle 12 is drawn in to the tube 32 via the tube end 34 and travels through the tube 32 and is dispensed out of the nozzle 26. The fluid level within the bottle 12 lowers as the fluid is dispensed through the nozzle 26. The bottle 12 may additionally include a secondary reservoir to facilitate dispensing of the fluid when the bottle 12 is tilted relative to a horizontal plane, as described in U.S. Provisional Application No. 61/097,827 entitled Spray Bottle with Primary and Secondary Internal Reservoirs, the entire contents of which are expressly incorporated herein by reference.

As shown in FIGS. 2-5, a contemplated refill cartridge 36 includes a cartridge body 38 defining a reservoir 40 configured to store fluid. A contemplated cartridge body 38 is preferably formed of a fluid impermeable material, such as plastic or rubber. As depicted, the cartridge body 38 is substantially cylindrical in shape and extends along a longitudinal cartridge axis 48. In this manner, the cartridge body 38 is sized and configured to be disposed within the upper neck portion 18 of the bottle 12, as described in more detail below. Those skilled in the art will appreciate that the cartridge body 38 may define other non-cylindrical shapes and configurations.

In some embodiments, a contemplated cartridge body 38 defines a first opening 42 and a second opening 46 at respective opposing ends of the cartridge body 38. The cartridge body 38 includes a flange 45 extending about the first opening 42. The flange 45 has an outer diameter that is greater than the diameter of the rim of the bottle 12 which defines a bottle opening thereof, as best shown in FIG. 1. In this manner, the refill cartridge 36 may be inserted within the bottle reservoir 16 with the flange 45 resting on the rim of the bottle 12 defined at the bottle opening thereof. The refill cartridge 36 may also be designed as part of the original bottle, such that it is a receptacle for a refill pouch or degradable cartridge.

Figure 5:
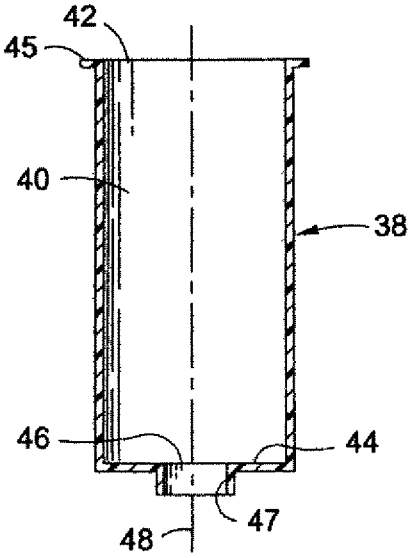
FIG. 5 is a side sectional view of the cartridge body depicted in FIG. 4.

As shown in FIG. 5, a contemplated cartridge body 38 of a contemplated refill cartridge 36 also includes a bottom wall 44 having a ring-like projection 47 which protrudes from the approximate center thereof and defines the second opening 46. The projection 47 has an outer diameter that is smaller than the maximum outer diameter of the cartridge body 38. The first and second openings 42, 46 are coaxially aligned with each other along the cartridge axis 48. As described in more detail below, a release mechanism, herein shown as plug 72, may be inserted into the ring opening 47 (as shown in FIG. 1) to provide a fluid tight seal between the plug 72 and the cartridge ring 44 to mitigate fluid flow through the ring opening 47. In contemplated embodiments, the release mechanism may comprise a degradable material that is designed to slowly break down in the presence of water or another liquid in order to release the concentrated refill into the bottle. In other embodiments, a contemplated release mechanism may comprise a plastic or other material that is not degradable and is designed to be removed and discarded. In yet other embodiments, a contemplated release mechanism may be replaced by another material utilized to keep the concentrated solution in the refill cartridge.

In FIGS. 6-10, a contemplated refill cartridge 36 also includes a cap 50 that is engageable with the cartridge body 38 at the first opening 42 to substantially cover the first opening 42. A contemplated cap 50 includes a cap base 56 and a cap wall 52 extending upwardly from the cap base 56. A cap flange 54 may circumscribe and protrude radially from the upper end of the cap wall 52 (opposite the cap base 56). The cap base 56 includes a primary opening 62 formed therein. The cap wall 52 and the cap base 56 collectively define a cavity 58. As shown in this embodiment, the cap wall 52 is substantially cylindrical in shape, and is complimentary to the shape of the cartridge body 38; however, for other cartridge body designs, the cap wall may comprise another complimentary shape. In some embodiments, the outer diameter of the cap wall 52 is slightly smaller than the inner diameter of the cartridge body 38 at the first opening 42 to allow the cap 50 to be partially advanced into the cartridge body 38 when engaged thereto. In some embodiments, the cap may be molded as part of the cartridge body, such that it is not a separate component.

The cap 50 may also include a tubular cap boss 60 that extends axially downwardly from the cap base 56 along an axis 70. The cap boss 60 includes a tapered inner wall 64 defining a passage 61 that is coaxially aligned with the primary opening 62.

The cap 50 may be placed within the first opening 42 of the cartridge body 38 of the refill cartridge 36 to cover and enclose the first opening 42. In this manner, the cap flange 54 preferably abuts the flange 45. When the cap 50 is connected to the cartridge body 38, the cap axis 70 is preferably aligned with the cartridge axis 48. As a result, the cap axis 70 is coaxially aligned with the cartridge axis 48. Once the cap 50 is engaged with the cartridge body 38, the cap 50 may be sealed to the cartridge body 38. In this regard, the interface between the cap 50 and the cartridge body 38 may be a substantially fluid tight seal.

Figure 6:
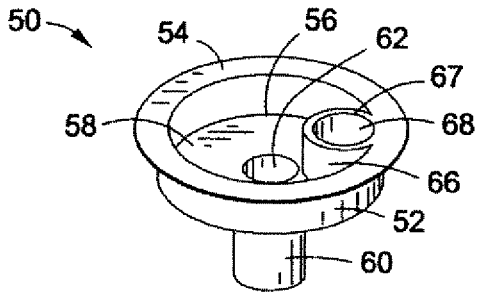
FIG. 6 is a top perspective view of the cap of the refill cartridge.
Figure 7:
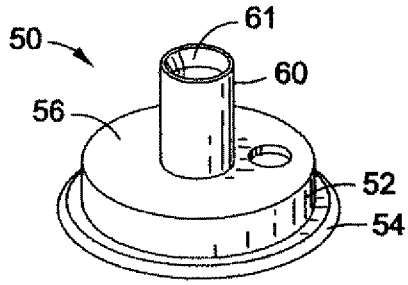
FIG. 7 is a top perspective view of the cap illustrated in FIG. 6, the cap being rotated 180 degrees.
Figure 8:
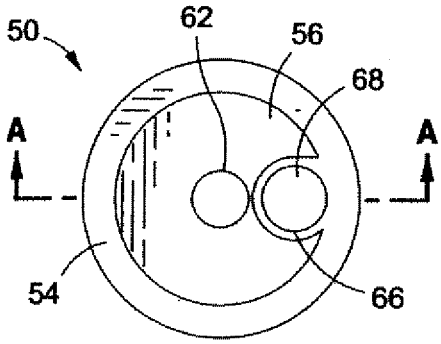
FIG. 8 is a top plan view of the cap.
Figure 9:
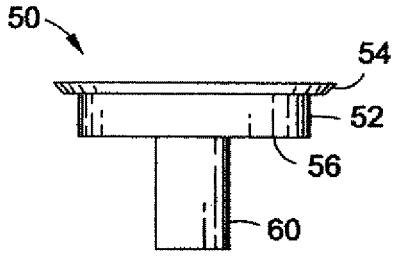
FIG. 9 is a side elevational view of the cap illustrated in FIG. 8.
Figure 10:
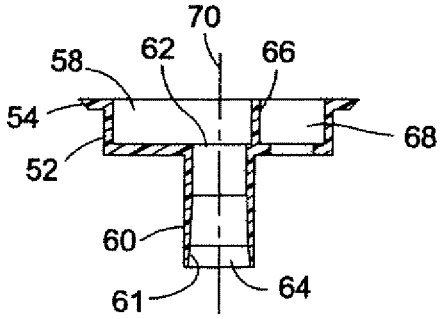
FIG. 10 is a cross-sectional view of the cap illustrated in FIG. 8.

In a contemplated embodiment, the cap 50 also includes a ring-like projection 66 extending upwardly from the cap base 56 toward the cap flange 54. As shown in FIGS. 6 and 8, the projection 66 is offset from the center of the cap 50, with a portion of the projection 66 abutting the cap wall 52. However, it is understood that other embodiments of the cap 50 may include a projection 66 that does not abut the cap wall 52. The projection 66 includes an inner wall 67 defining a secondary opening 68 that extends through the cap base 56 and fluidly communicates with the reservoir 40 of the cartridge body 38. When the cap 50 is connected to the cartridge body 38, the refill cartridge 36 may be filled with a fluid via the secondary opening 68. Once the reservoir 40 is filled, it is contemplated that the secondary opening 68 will be sealed with a release mechanism, which may include a suitable plug or degradable plug-like component.

Figure 12:
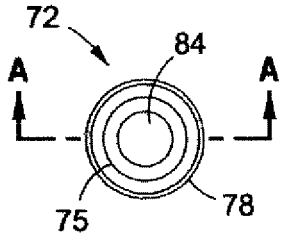
FIG. 12 is a top plan view of the release mechanism, which in this embodiment is a plug.
Figure 11:
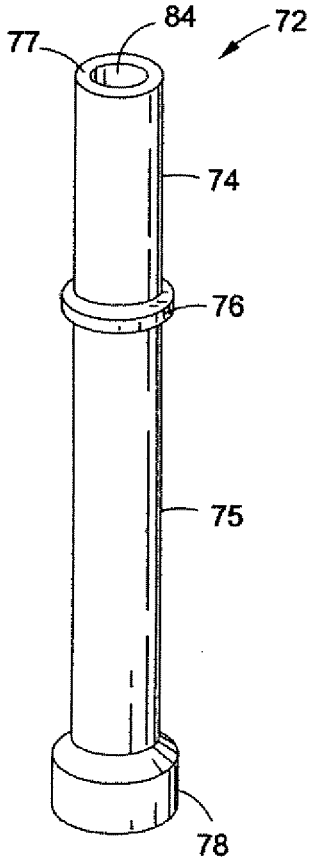
FIG. 11 is a top perspective view of the plug of the refill cartridge.
Figure 13:
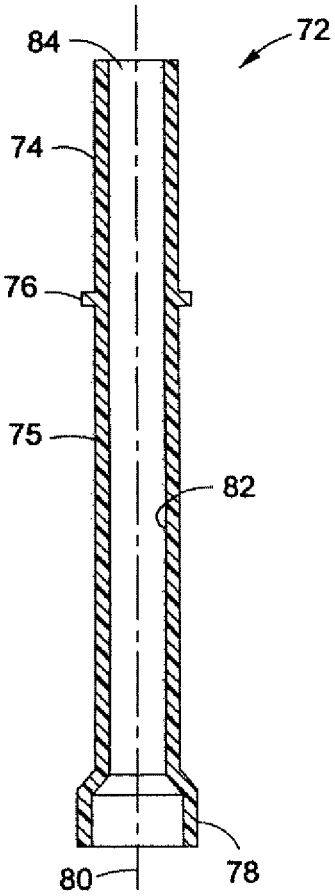
FIG. 13 is a cross-sectional view of the release mechanism, which in this embodiment is a plug, as illustrated in FIG. 12.

FIGS. 11-13 show a release mechanism, which is represented as plug 72 in this embodiment, that is insertable into the cartridge body 38 to engage with the cartridge body 38 and the cap 50. The plug 72 includes a plug body 75 having a plug neck 74 defining a distal end 77. A plug flange 76 circumscribes the plug body 75 and extends radially outwardly therefrom. The plug 72 also includes a flared portion 78 having an outer diameter that is larger than the outer diameter of the plug body 75. The plug 72 further includes a plug inner wall 82 defining a flow passage 84 which extends along a plug axis 80. The diameter of the plug inner wall 82 is slightly larger than the outer diameter of the tube 32. In this manner, the tube 32 may be slidably advanced through the plug 72, and hence refill cartridge 36, as shown in FIG. 1.

As used herein, and as outlined earlier, the "plug" is included in the group of release mechanisms, wherein these release mechanisms comprise a plug, a release tube, a degradable interface material, a removable interface or a combination thereof and/or any suitable release mechanism. Contemplated degradable interface materials are those designed to interact with air, water or another chemical in order to degrade and release concentrated chemical agent into the bottle. A contemplated removable interface includes those materials that are not considered "plugs" or degradable interfaces, but yet are removable, such as plastic strips.

In a contemplated embodiment, a release mechanism, herein shown as plug 72, is insertable into the cartridge body 38 via the second opening 46 for engagement with the cartridge body 38 and the cap 50. More specifically, the plug neck 74 and plug flange 76 are insertable through the second opening 48 to bring the plug neck 74 into frictional engagement with the cap boss 60, and to bring the flared portion 48 into concurrent frictional engagement with the projection 47 in the manner shown in FIG. 1. In this manner, the plug neck 74 and plug flange 76 are sized and configured to pass through the second opening 46, while the outer surface of the flared portion 48 is sized and configured to frictionally engage the inner surface of the projection 47. Similarly, the outer surface of the plug neck 74 is sized and configured to frictionally engage the inner wall 64 of the cap boss 60. The advancement of the plug neck 74 through the cap boss 60 may be limited by the abutment of the plug flange 76 against the distal end or rim defined by the plug boss 60. When the flared portion 78 is frictionally engaged to the projection 47 and the plug neck 74 frictionally engaged to the plug boss 60, the distal end 77 of the plug 74 typically resides within the cavity 58 of the cap 50, as also shown in FIG. 1.

In some embodiments, a release mechanism, herein shown as plug 72, is moveable relative to the cap 50 and the cartridge body 38 between a sealing position (shown in FIG. 1) and a dispensing position. In the sealing position, the plug neck 72 is engaged with a cap arm 60 via a friction type engagement. Furthermore, the flared portion 78 is frictionally engaged with the projection 47 to form a fluid tight seal therebetween. The fluid tight seal mitigates loss of fluid from the cartridge reservoir 40 through the second opening 46. When the plug 72 is in the sealing position, the plug flange 76 is preferably disposed in contact with the distal end of the cap boss 60. As will be recognized, the plug 72 will be operatively coupled to the cap 50 and cartridge body 38 in the aforementioned manner prior to filling the reservoir 40 with a concentrated fluid via the secondary opening 68 of the cap 50.

The application of downward pressure to the exposed distal end 77 of the plug 72 facilitates the movement thereof to its dispensing position. As the plug 72 is moved from the sealing position toward the dispensing position, the flared portion 78 is moved downwardly out of fluid tight engagement with the projection 47. In this manner, the flared portion 78 moves along the cartridge axis 48 out of fluid tight engagement with the projection 47. The plug neck 74 also moves downwardly relative to the cap boss 60, but remains in frictional engagement with the cap boss 60 when the plug 72 is in the dispensing position. In this manner, the plug 72 is held in engagement with the cap 50 to prevent the plug 72 from falling through the second opening 46. As the plug 72 moves from the sealing position toward the dispensing position, the plug flange 76 moves out of contact with the cap boss 60.

It is contemplated that the refill cartridge 36 may be sold separate from the bottle 12 and the pumping mechanism 22. In other words, a user may purchase the refill cartridge 36 to refill the bottle 12 when the fluid within the bottle 12 is empty. It is also contemplated that the refill cartridge 36 may be sold with the bottle 12, or with the pumping mechanism 22. When sold with the bottle 12, the cartridge 36 and bottle 12 may be used with an existing pumping mechanism 22. Conversely, when sold with a pumping mechanism 22, the refill cartridge 36 and pumping mechanism 22 will be used with an existing bottle 12. The refill cartridge 36 may also be sold with a new bottle 12 and pumping mechanism 22. In this manner, the bottle 12 may include fluid for dispensing by the pumping mechanism 22. When the fluid level within the bottle decreases to the point where bottle 12 is effectively empty, the fluid within the on-board refill cartridge 36 may be used to refill the bottle 12. When the refill cartridge 36 is provided with the new bottle 12, the abutted flanges 54, 45 which overlie the rim of the bottle 12 are secured to the rim by the pump attachment element 30 of the pumping mechanism 22. The tube 32 of the pumping mechanism 22 is extended through and is thus accommodated by the flow passage 84 of the plug 72 as described above.

The use of the refill cartridge 36, when sold with the new bottle 12 and pumping mechanism 22, is as follows. When the fluid level in the bottle 12 is sufficiently low, the pumping mechanism 22 is removed from the bottle 12 to provide access to the refill cartridge 36. In most cases, the fluid within the refill cartridge 36 contains a highly concentrated level of the fluid that was previously in the bottle 12. The refill cartridge 36 is removed from within the interior of the bottle 12 by grasping the abutted flanges 54, 45 which overlie the rim of the bottle 12. Thereafter, water or other diluting fluid may be filled into the bottle 12 prior to dispensing the fluid within the refill cartridge 36 into the bottle 12. Typically, if the fluid within the refill cartridge 36 is filled into the bottle 12 prior to filling a diluting fluid in the bottle 12, the concentrated fluid emptied into the bottle 12 will begin to bubble as the diluting fluid is filled into the bottle 12. Therefore, it may be desirable to fill the diluting fluid into the bottle 12 prior to filling the concentrated fluid from the refill cartridge 36 into the bottle 12. To this end, the bottle 12 may include a marking to indicate how much diluting fluid is required for use with the concentrated fluid.

After the diluting fluid is sufficiently filled within the bottle 12, the cartridge 36 is reinserted into the bottle 12 by passing it through the bottle opening and resting the abutted flanges 54, 45 upon the bottle rim which defines the bottle opening, as shown in FIG. 1. The concentrated fluid within the refill cartridge 36 may then be dispensed into the bottle 12. To dispense the fluid within the refill cartridge 36, the plug neck 74 is pushed by a user from the sealing position toward the dispensing position. More specifically, the distal end 77 is pushed by a user toward the cap base 56. In this regard, the fluid tight seal between the flared portion 78 and the projection 47 is broken, thereby allowing the fluid within the refill cartridge 36 to exit the cartridge reservoir 40 via the second opening 46 and into the bottle 12. After the fluid is dispensed into the bottle 12, the pumping mechanism 22 is reattached to the bottle 12. At this point, the refill cartridge 36 does not have to be disposed within the bottle 12, but rather can be removed in the aforementioned manner and discarded. After the pumping mechanism 22 is connected to the bottle 12, the user may then shake the bottle 12 to mix the highly concentrated fluid with the diluting fluid. Once the fluids are mixed, the spray bottle assembly 10 may be used to dispense the fluid.

Figure 14:
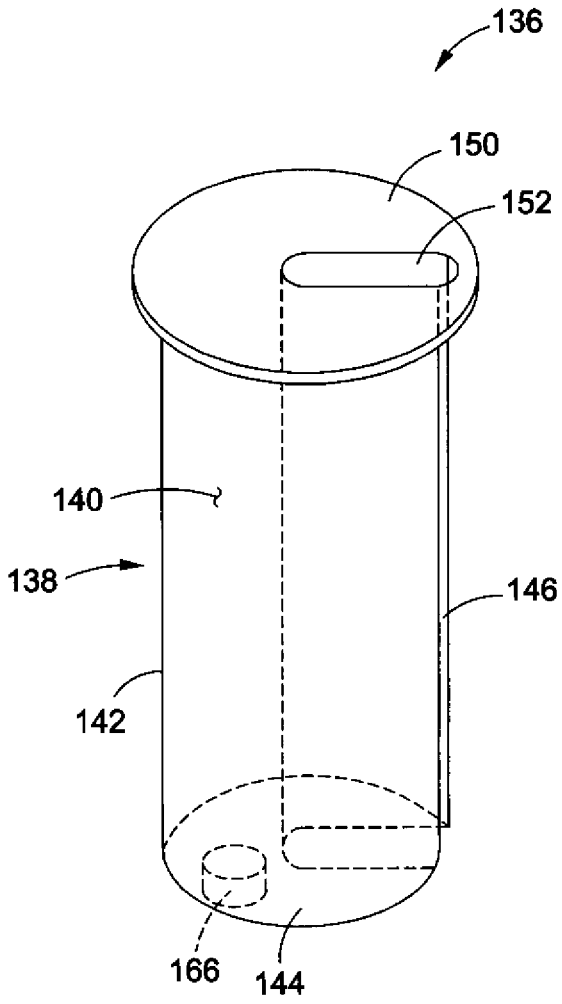
FIG. 14 is a top perspective view of an alternative embodiment of the refill cartridge.

As shown in FIG. 14, a contemplated refill cartridge 136 may be substituted for the above-described refill cartridge 36. The refill cartridge 136 includes a cartridge body 138 defining a reservoir 140 configured to store fluid. In this manner, the cartridge body 138 is preferably formed of a fluid impermeable material, such as plastic or rubber. As shown in FIG. 14, the cartridge body 138 has a substantially cylindrical configuration, and includes a side wall 142, a bottom wall 144 which is integrally connected to one end of the side wall 142, and a top wall (not shown) which is integrally connected to the remaining end of the side wall 142. Formed in the side wall 142 of the cartridge body 138 is an elongate channel 146 which extends from the bottom wall 144 to the top wall. The channel 146 is used for reasons which will be described in more detail below.

It addition to the cartridge body 138, the refill cartridge 132 includes a cap 150 that is attached to the top wall of the cartridge body 138. The cap 150 is sized so as to include a peripheral portion which protrudes radially outward relative to the outer surface of the side wall 142 of the cartridge body 138. The cap 150 also includes an elongate slot 152 formed therein which communicates with the channel 146 in the manner shown in FIG. 14. Those of ordinary skill in the art will recognize that the cartridge body 138 may be formed so as not to include the top wall, with the cap 150 being integrally connected to the side wall 142 such that the slot 152 communicates with the channel 146 in the aforementioned manner.

As is further shown in FIG. 14, it is contemplated that the bottom wall 144 may include a ring-like projection 166 which extends therefrom and is offset from the center thereof. The projection 166 defines an opening that extends through the bottom wall 144 and fluidly communicates with the reservoir 140 of the cartridge body 138. In this regard, the refill cartridge 136 may be filled with the fluid via the opening of the projection 166, with such opening being sealed with a suitable plug once the reservoir 140 is filled with the fluid.

When sold with the bottle 12, the refill cartridge 136 resides within the reservoir 16 of the bottle 12, with the peripheral portion of the cap 150 which overhangs the cartridge body 138 resting on the rim of the bottle 12 in the same manner as the flange 45 of the above-described refill cartridge 36. The attachment of the pumping mechanism 22 to the bottle 12 effectively compresses the peripheral portion of the cap 150 between the pump attachment element 30 and the rim, thus securing the refill cartridge 136 to the bottle 12. At the same time, the tube 32 of the pumping mechanism 22 is accommodated by the channel 146 and the slot 152 within the cap 150, the tube 32 extending through the refill cartridge 136.

When the fluid level in the bottle 12 is sufficiently low, the pumping mechanism 22 is removed from the bottle 12 to provide access to the refill cartridge 136. The refill cartridge 136 is removed from within the interior of the bottle 12 by grasping the peripheral portion of the cap 150 which overlies the rim of the bottle 12. Thereafter, water or other diluting fluid may be filled into the bottle 12 prior to dispensing the fluid within the refill cartridge 136 into the bottle 12. After the diluting fluid is sufficiently filled within the bottle 12, the plug is removed from within the projection 166, with the contents of the refill cartridge 136 thereafter being poured into the diluting fluid within the bottle 12. After the concentrated fluid is dispensed into the bottle 12, the pumping mechanism 22 is reattached to the bottle 12. At this point, the refill cartridge 136 does not have to be disposed within the bottle 12, but rather can be discarded. After the pumping mechanism 22 is reattached to the bottle 12, the user may then shake the bottle 12 to mix the highly concentrated fluid with the diluting fluid. Once the fluids are mixed, the spray bottle assembly 10 may be used to dispense the fluid.

Figure 15:
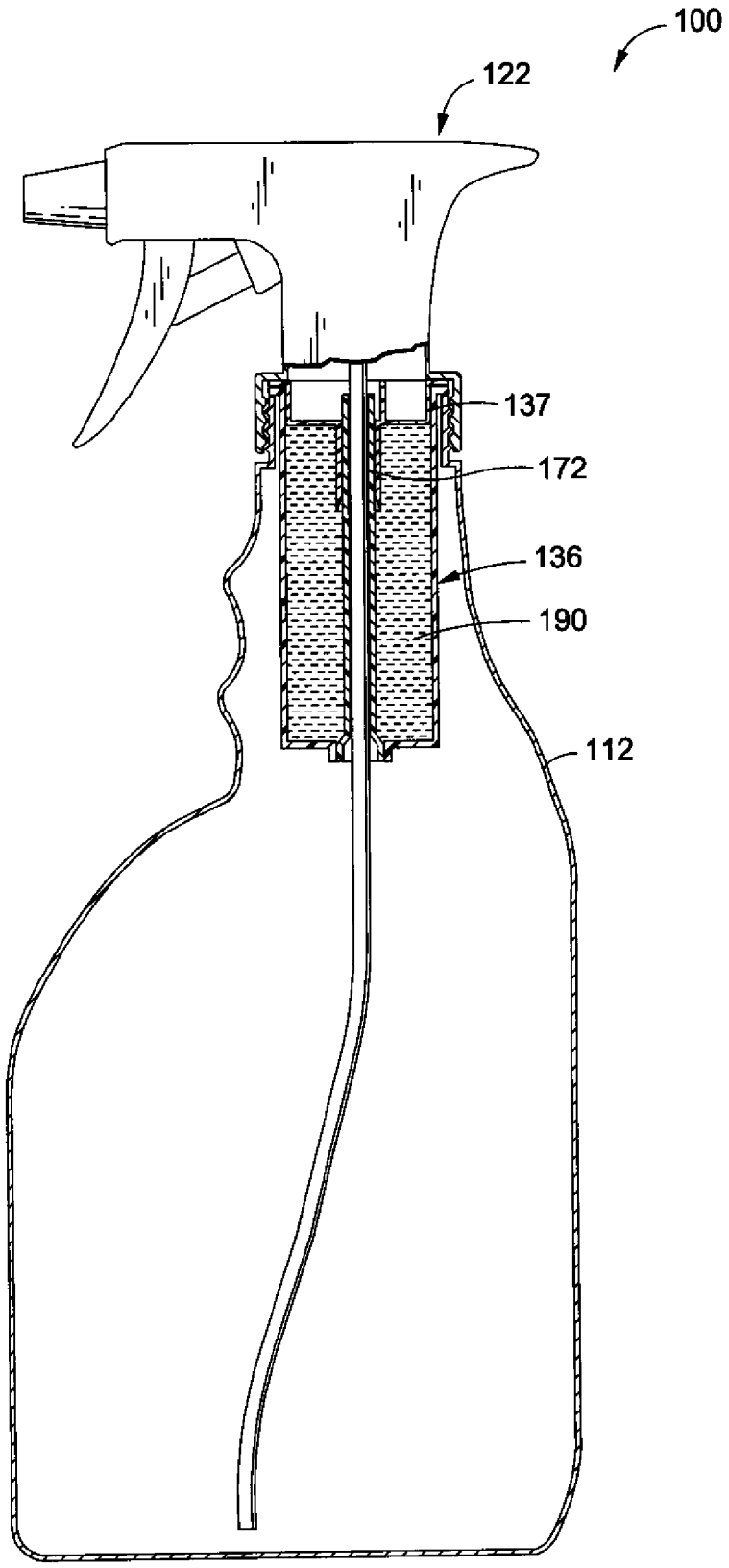
FIG. 15 is a side sectional view of a spray bottle assembly constructed in accordance with another contemplated embodiment, the spray bottle assembly including a bottle, a pumping mechanism, and a refill cartridge having a cartridge body, a cap, and a release mechanism, which in this embodiment is a release tube that is closed.
Figure 16:
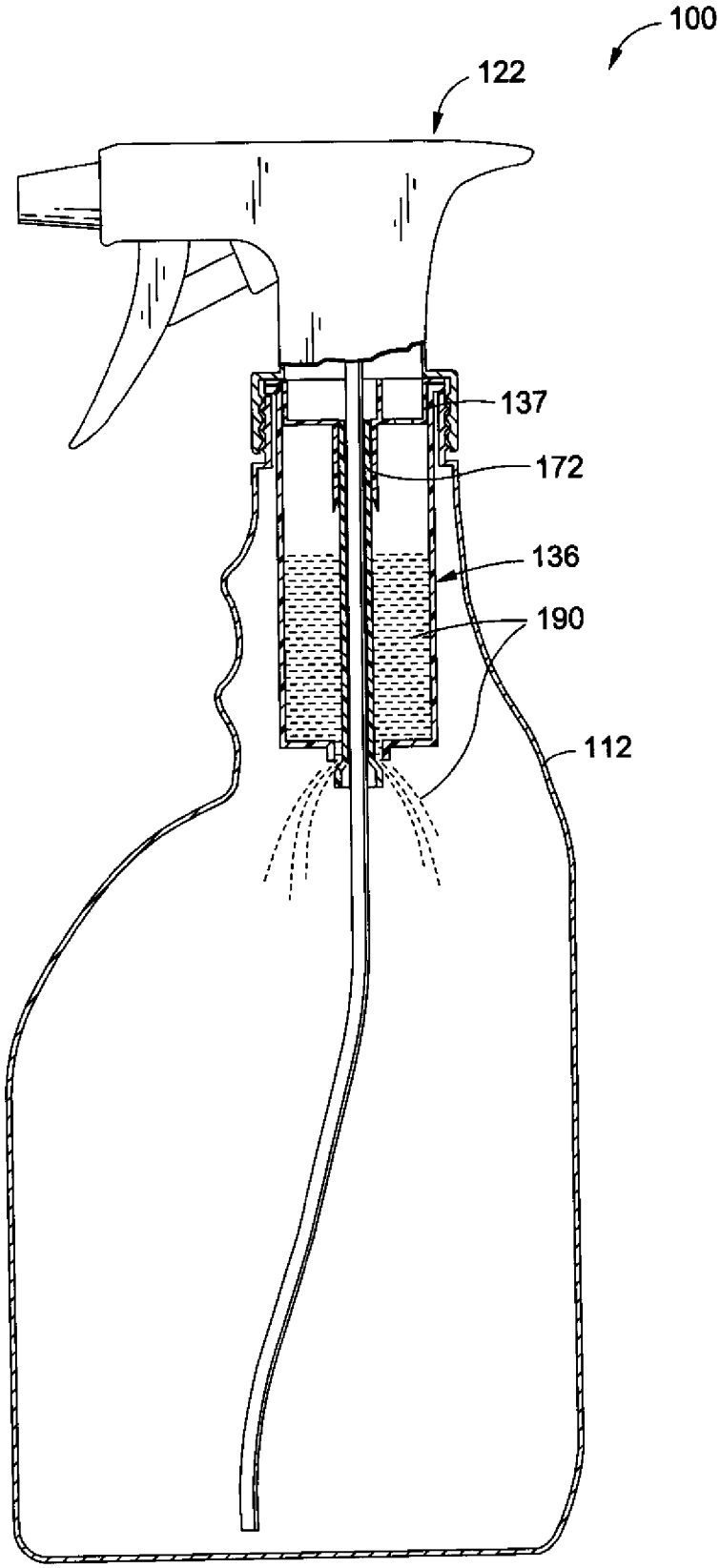
FIG. 16 is a side sectional view of a spray bottle assembly constructed in accordance with another contemplated embodiment that is shown in FIG. 15, the spray bottle assembly including a bottle, a pumping mechanism, and a refill cartridge having a cartridge body, a cap, and a release mechanism, which in this embodiment is a release tube that is open releasing chemical agent into the bottle.

FIGS. 15 and 16 illustrate another contemplated spray bottle assembly 100 constructed in accordance with a contemplated embodiment. The spray bottle assembly 100 may be used to easily dispense fluids, such as cleaning fluids, detergents, cosmetic fluids, perfumes, or other suitable fluids. As described in more detail below, the spray bottle assembly 100 includes a pumping mechanism 122, a bottle 112 and a refill cartridge 136 that is disposable within the bottle 112. It is contemplated that the refill cartridge 136 may be packaged within the bottle 112 for sale. The easy-to-use configuration of the refill cartridge 136 allows for simple refilling of the bottle 112, thereby extending the usage of the bottle 112, which provides environmental and economic advantages. In the embodiment, the release mechanism comprises a release tube 172, wherein when the release tube 172 is in the closed position (FIG. 15), the chemical agent 190 remains in the refill cartridge 136. When the release tube 173 is in the open position (FIG. 16), the chemical agent 190 is dispersed into the bottle 112. In these embodiments, the user (not shown) needs to only press down on the top of the release tube 172, in order to move it to the open position 173 and disperse the chemical agent 190. When the bottle is empty, the release tube can be reengaged by pressing up on the release tube in the open position 173 to move it back to the closed position 172. Additional chemical agent (not shown) can then be added to the refill cartridge 136 by removing the lid 137.

Figure 17:
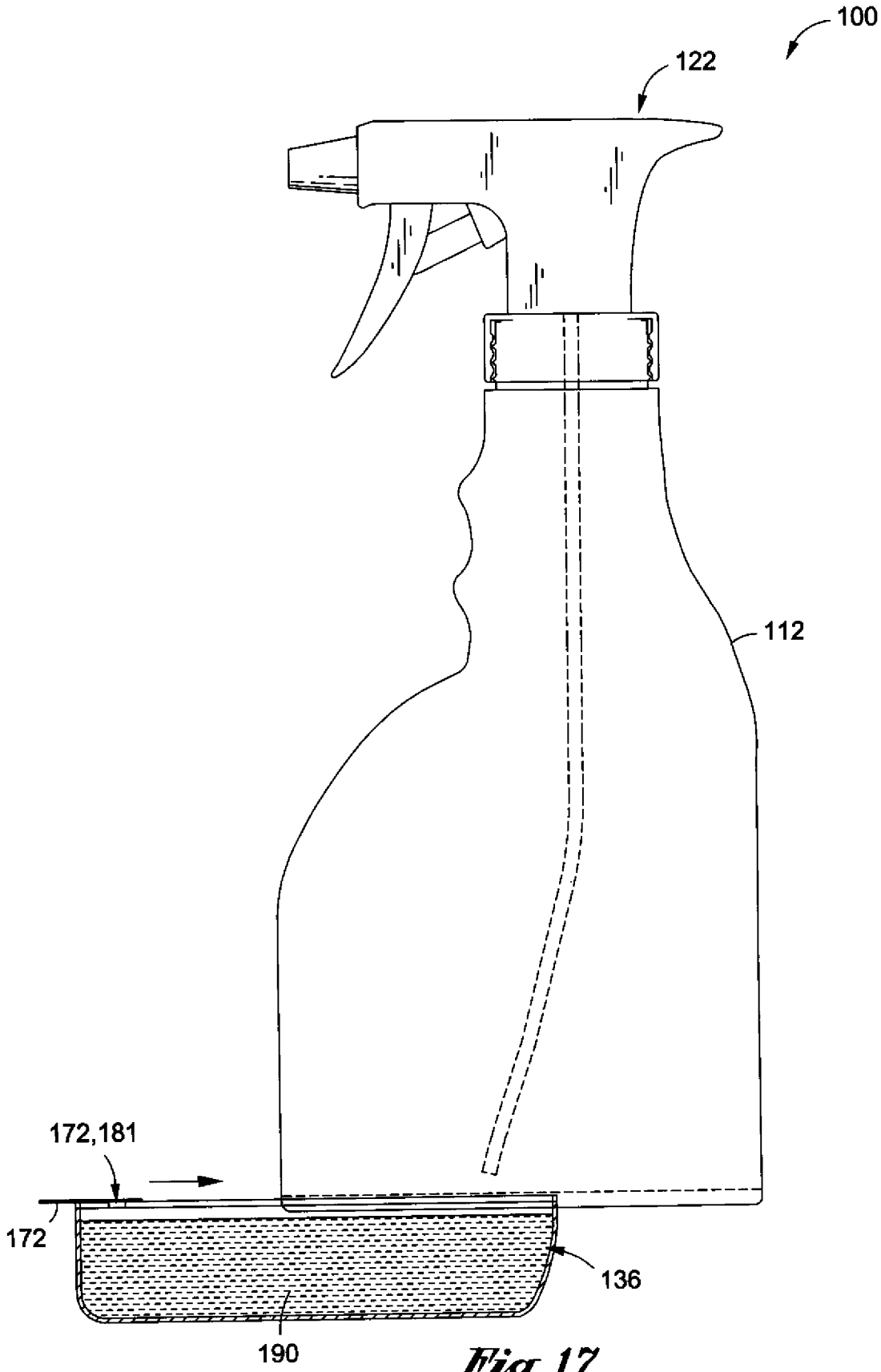
FIG. 17 is a side sectional view of a spray bottle assembly constructed in accordance with another contemplated embodiment, the spray bottle assembly including a bottle, a pumping mechanism, and a refill cartridge having a cartridge body and a release mechanism, which in this embodiment is a release strip that is engaged on the refill cartridge.
Figure 18:
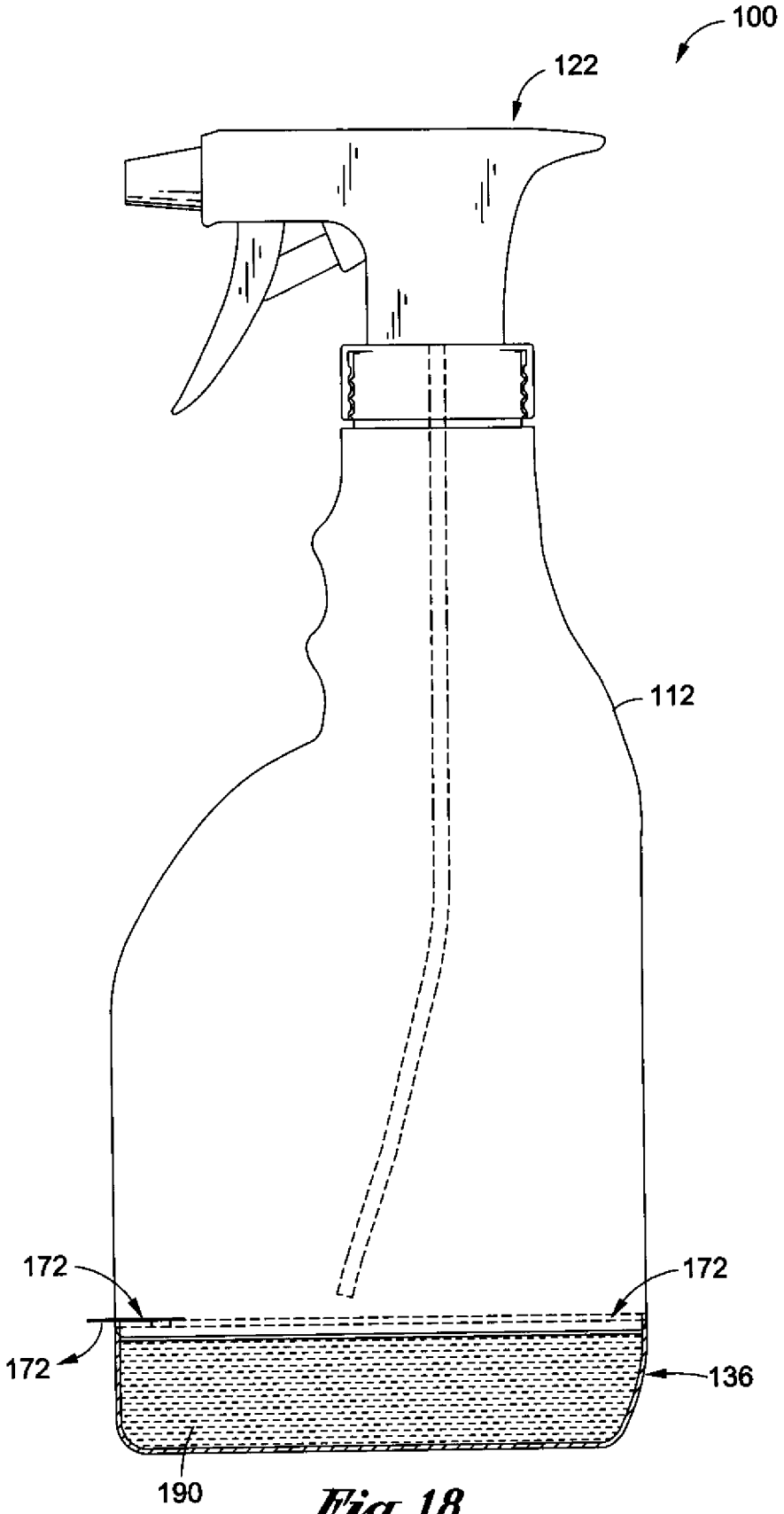
FIG. 18 is a side sectional view of a spray bottle assembly constructed in accordance with another contemplated embodiment that is shown in FIG. 17, the spray bottle assembly including a bottle, a pumping mechanism, and a refill cartridge having a cartridge body and a release mechanism, which in this embodiment is a release strip that is engaged on the refill cartridge.

FIGS. 17 and 18 illustrate another contemplated spray bottle assembly 100 constructed in accordance with a contemplated embodiment. The spray bottle assembly 100 may be used to easily dispense fluids, such as cleaning fluids, detergents, cosmetic fluids, perfumes, or other suitable fluids. As described in more detail below, the spray bottle assembly 100 includes a pumping mechanism 122, a bottle 112 and a refill cartridge 136 that is disposable onto the bottle 112. It is contemplated that the refill cartridge 136 may be packaged on the bottle 112 for sale. The easy-to-use configuration of the refill cartridge 136 allows for simple refilling of the bottle 112, thereby extending the usage of the bottle 112, which provides environmental and economic advantages. In the embodiment, the release mechanism comprises a release strip 172, wherein when the release strip 172 is in the closed position, the chemical agent 190 remains in the refill cartridge 136. When the release strip 172 is pulled out (not shown), the chemical agent 190 is dispersed into the bottle 112. In these embodiments, the user (not shown) needs to only slide 181 the refill cartridge 136 on to the bottom of the bottle 112. Once the release strip 172 is removed, the refill cartridge 136 is open to the bottle 112 and the chemical agent 190 can freely flow within both the refill cartridge 136 and the bottle 112.

Thus, specific embodiments and applications of containment vessels, spray bottles and refill components for use with corresponding spray bottles, along with their methods of use have been disclosed. It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

I claim:

1. A refill assembly comprising:

a bottle having an internal reservoir, an opening and a rim;

a refill cartridge operatively coupled to the bottle and at least partially residing within the reservoir thereof, the refill cartridge having a dispensing end, an opposing upper end defining an upper cartridge plane, and a cartridge reservoir adapted to have a concentrated chemical agent stored therein; and a release mechanism operatively coupled to the refill cartridge and being selectively movable from a sealing position to a dispensing position relative thereto, the movement of the release mechanism from the sealing position to the dispensing position facilitating the flow of the chemical agent from the cartridge reservoir into the internal reservoir of the bottle;

the release mechanism including an actuating segment, the release mechanism and refill cartridge being configured such that the actuating segment extends outwardly from refill cartridge away from the cartridge reservoir and does not traverse the upper cartridge plane when the release mechanism is in the sealing position.

2. The refill assembly of claim 1, wherein the release mechanism comprises a plug, a release tube, a degradable interface material, a removable interface, a release strip or a combination thereof.

3. The refill assembly of claim 1, wherein the opening of the bottle is defined by the rim, and the refill cartridge includes a flange portion which is abutted against the rim.

4. The refill assembly of claim 1, further comprising a pumping mechanism cooperatively engaged to the bottle in a manner maintaining the flange portion of the refill cartridge in abutting contact with the rim of the bottle.

5. The refill assembly of claim 1, wherein the chemical agent comprises a liquid, a gel, a solid tablet, a plurality of solid granules or a combination thereof.

6. The refill assembly of claim 1, wherein the release mechanism includes an exposed distal end engageable with a remote actuation member to facilitate movement of the release mechanism from the sealing position to the dispensing position.

7. The refill assembly of claim 1, wherein the release mechanism includes a distal end engageable with a remote actuation member to facilitate movement of the release mechanism from the sealing position to the dispensing position.

8. The refill assembly of claim 1, wherein the refill cartridge includes a cartridge body and a cap connectable to the cartridge body and engaged with the release mechanism such that the release mechanism extends through a cap opening formed within the cap.

9. The refill assembly of claim 8, wherein the release mechanism extends from the cap in opposed directions when the release mechanism is in the sealing position.

10. The refill assembly of claim 8, wherein the cap includes a cap base, the cap opening extending through the cap base.

11. The refill assembly of claim 10, wherein the cap opening defines an opening diameter and the release mechanism defines a release diameter smaller than the opening diameter.

12. A refill assembly comprising:

a refill cartridge having a dispensing end, an opposing upper end defining an upper cartridge plane, and a cartridge reservoir adapted to have a concentrated chemical agent stored therein; and a release mechanism operatively coupled to the refill cartridge and being selectively movable from a sealing position to a dispensing position relative thereto, the movement of the release mechanism from the sealing position to the dispensing position facilitating the flow of the chemical agent from the cartridge reservoir;

the release mechanism including an actuating segment, the release mechanism and refill cartridge being configured such that the actuating segment extends outwardly from the refill cartridge away the cartridge reservoir and does not traverse the upper cartridge plane when the release mechanism is in the sealing position.

13. The refill assembly of claim 12, wherein the release mechanism comprises a plug, a release tube, a degradable interface material, a removable interface, a release strip or a combination thereof.

14. The refill assembly of claim 12, wherein the chemical agent comprises a liquid, a gel, a solid tablet, a plurality of solid granules or a combination thereof.

15. The refill assembly of claim 12, wherein the release mechanism includes an exposed distal end engageable with a remote actuation member to facilitate movement of the release mechanism from the sealing position to the dispensing position.

16. The refill assembly of claim 12, wherein the release mechanism includes a distal end engageable with a remote actuation member to facilitate movement of the release mechanism from the sealing position to the dispensing position.

17. The refill assembly of claim 12, wherein the refill cartridge includes a cartridge body and a cap connectable to the cartridge body and engaged with the release mechanism such that the release mechanism extends through a cap opening formed within the cap.

18. The refill assembly of claim 17, wherein the release mechanism extends from the cap in opposed directions when the release mechanism is in the sealing position.

19. The refill assembly of claim 17, wherein the cap includes a cap base, the cap opening extending through the cap base.

20. The refill assembly of claim 17, wherein the cap opening defines an opening diameter and the release mechanism defines a release diameter smaller than the opening diameter.

* * * * *